US006029581A

United States Patent [19]

Daoud

[11] Patent Number: 6,029,581

[45] Date of Patent: Feb. 29, 2000

[54] PIVOTABLE WORK TABLE

[75] Inventor: Bassel H. Daoud, Parsippany, N.J.

[73] Assignee: Lucent Technologies, Inc., Murray Hill, N.J.

[21] Appl. No.: 09/065,121

[22] Filed: Apr. 23, 1998

[51] Int. Cl.[7] ..... A47B 3/00

[52] U.S. Cl. ..... 108/33; 108/42

[58] Field of Search ..... 108/33, 37, 40, 108/39, 36, 42, 47, 48, 35, 115

[56] References Cited

U.S. PATENT DOCUMENTS

| | | | |
|---|---|---|---|
| 1,553,821 | 9/1925 | Johnson | 108/38 |
| 1,688,834 | 10/1928 | Sharp | 108/33 X |
| 1,753,423 | 4/1930 | Kroschel | 108/38 X |
| 1,768,413 | 6/1930 | Lyuth | 108/33 X |
| 2,586,543 | 2/1952 | Kennedy | 108/33 X |

*Primary Examiner*—Jose V. Chen
*Attorney, Agent, or Firm*—Synnestvedt & Lechner LLP

[57] ABSTRACT

A pivotable work table for use with an electrical junction box is disclosed. The work table has a table member which is pivotally movable between a retracted position within the junction box and an extended position in which the table is oriented perpendicular to the box. The table member is hingedly connected to one or more retention pins which extend from the table member and slidably engage one or more respective bosses attached to the junction box. Coil springs coaxially disposed around the retention pins provide biasing forces which draw the table member toward the bosses and maintain the table member in either the retracted or extended positions.

25 Claims, 6 Drawing Sheets

PIVOTABLE WORK TABLE

FIELD OF THE INVENTION

This invention relates to work tables which are movably attached to a device or structure to provide a work surface which can be stowed away when not in use.

BACKGROUND AND OBJECTS OF THE INVENTION

Junction boxes and other devices used for telecommunications, cable television, power distribution, control systems and the like often require servicing by technicians to, for example, add new telephone or cable service lines, replace malfunctioning components, polish and splice optical fibers, or replace circuit breakers or spent fuses. The technician must often use a number of tools or handle numerous small parts when servicing a box, and many technicians find it convenient to bring a portable work table which they set up near the box to provide a ready surface upon which to place their tools and components while they work.

While the use of a work table may be convenient, carrying the table from one site to another, setting it up and breaking it down is not. Additionally, the junction box or other device to be serviced may be mounted high above the ground on a structure such as the side of a building, a utility pole, or a microwave or a radio transmission tower, where there is no convenient place to set up an extra table for use by the technician.

Clearly there is a need to provide a convenient work table for use by technicians servicing equipment which would be useable under all conditions no matter where the device to be serviced was located. Ideally the work table should require only a minimum of time and effort to set up and break down, and it furthermore should not comprise an extra piece of equipment which a technician must transport to and from a work site.

It is an object of the invention to provide a convenient work surface for use by a technician when servicing a device.

It is an object of the invention to provide a work table which pivots between a retracted position where the table is out of the way, and an extended position in which the table provides a work surface to hold small tools and components.

It is yet another object of the invention to provide a work table which is positioned to catch small parts or tools if they are dropped by the technician.

SUMMARY OF THE INVENTION

The pivotable work table according to the invention provides a solution to the above identified problems. The work table is designed to be permanently mounted on the housing of a junction box or other device, either as a retrofit to the box or as original equipment. The table pivots between a retracted position, in which the table is fully enclosed within the housing of the box and out of the way, and an extended position in which the table presents a work surface which extends substantially at a right angle to the housing convenient for the placement of tools, components and the like. The table thus positioned is idealy suited to catch small parts which fall from the device or are dropped by the technician. Fewer parts will be lost or damaged if the pivotable work table according to the invention is used.

The pivotable work table has a table member comprising a substantially flat plate providing the work surface. A surface portion is disposed along one edge of the table member and oriented perpendicular to the plate. A hinge member is mounted on the plate adjacent to the surface portion.

A mounting assembly preferably comprising a boss is attached to the housing on which the work table is to be mounted and the surface portion of the table member is arranged adjacent to the boss with the hinge member opposite the boss. The boss has a surface facing the hinge member.

The mounting assembly further preferably comprises an interconnecting member hingedly attached to the hinge member and movably engaging the boss, thus providing a connection between the boss and the table member. A biasing member is disposed between the interconnecting member and the boss for biasing the table member toward the boss. The table member is pivotable via the hinge member between a retracted position in which the plate is oriented substantially parallel to the surface of the boss, and an extended position in which the plate is oriented substantially perpendicular to the surface of the boss. When the table member is in the retracted position the biasing member serves to urge an edge of the surface portion into contact with the surface of the boss and keep the table member in the retracted position. When the table member is in the extended position the biasing member serves to urge a region of the surface portion into contact with the surface of the boss and keep the table member in the extended position.

These and other objects of the invention will become apparent upon consideration of the drawings and detailed description of the preferred embodiment.

DETAILED DESCRIPTION OF PREFERRED EMBODIMENTS

Figure 1:
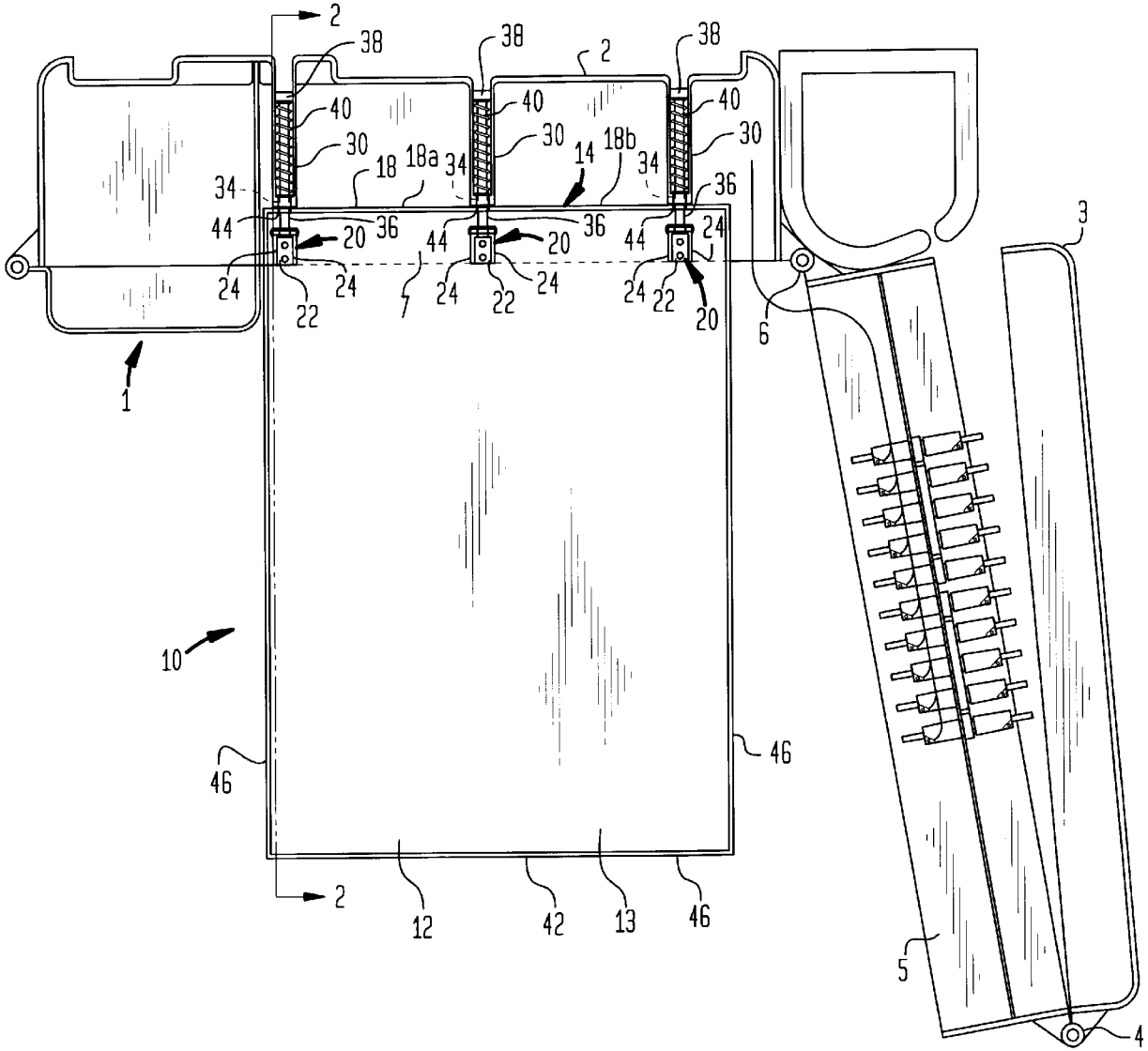
FIG. 1 is a cross sectional view from above showing a pivotable table in its extended position mounted within a building entry protection unit (BEP)

FIG. 1 shows a cross sectional view looking down on a building entry protection unit (BEP) 1 shown in the open position as it would be accessed by a technician during servicing. BEPs are commonly used to connect telephone lines within a building to the external lines of a regional telephone system. BEPs typically contain wiring blocks, connectors, and electrical surge protection equipment, and can also house optical fiber junctions as well as other components. BEP 1 comprises a housing 2, a cover 3 which swings on a hinge 4, and an inner door 5 which swings on a hinge 6. Both the inner door 5 and the housing 2 contain the various components of the BEP which a technician will service. Housing 2 has a mounting surface 7 located at the bottom of the housing.

A pivotable table 10 is shown mounted within BEP 1, table 10 comprising a table member 12 which is a substantially flat plate 13. Plate 13 has an end surface portion or flange 14, best seen in FIG. 4, comprising a curved segment 16 which extends from plate 13 through an arc of approximately 90°, and a straight segment 18 which extends from curved segment 16 and is oriented substantially perpendicular to plate 13. It is advantageous to provide sidewalls 46 entirely around the perimeter of plate 13. Sidewalls 46 extend substantially perpendicular to the plane of plate 13 and form a trough which prevents components on the table member from sliding or rolling off of the table member and being lost on the ground.

Although pivotable table 10 is shown in conjunction with a BEP, it is understood that the invention is not limited to this use and that table 10 could be used in conjunction with a wide range of housings, junction boxes and other devices or structures.

Figure 4:
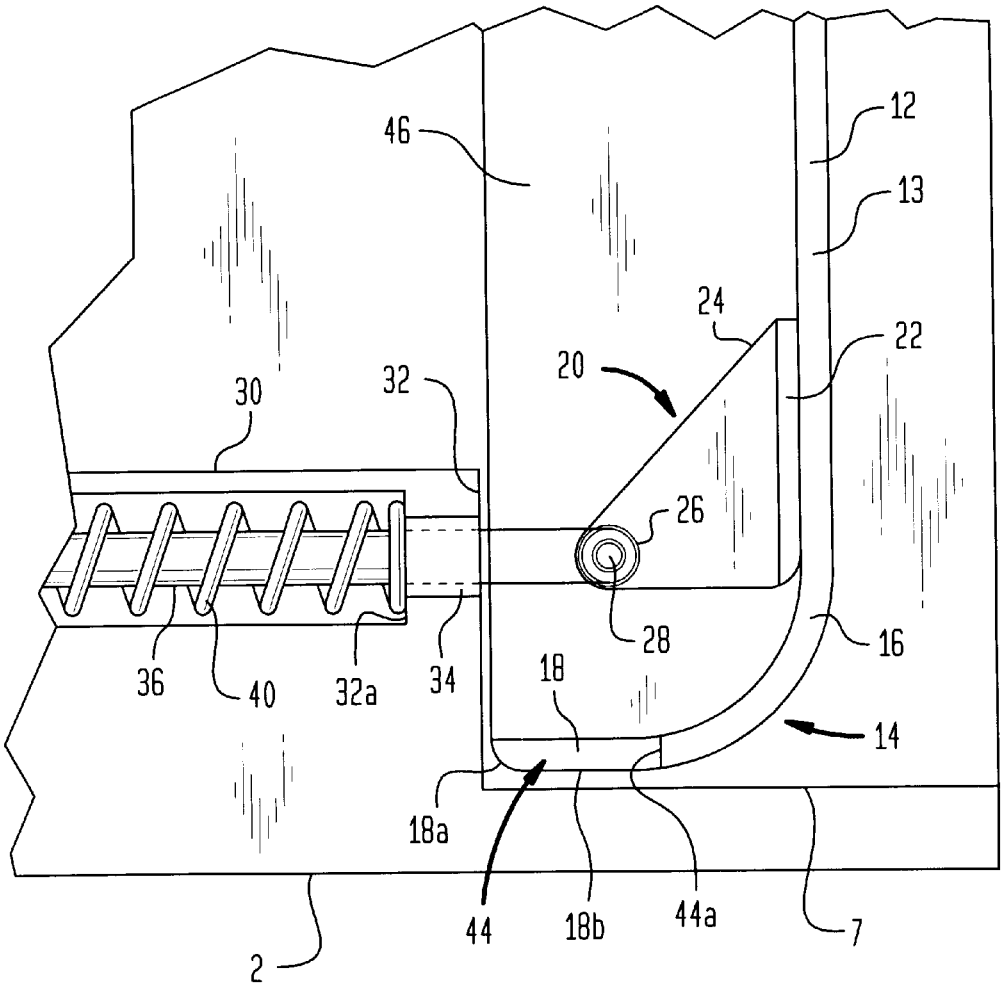
FIG. 4 is a detailed cross sectional view of a portion of FIG. 2 on an enlarged scale.

Hinge brackets 20 are mounted to plate 13, a plurality of hinge brackets 20 being shown and preferred, but it being understood that a single hinge bracket could also suffice. As seen in FIG. 4, each hinge bracket 20 preferably comprises a mounting flange 22 which provides an interfacing surface for attachment of hinge bracket 20 to plate 13. Any manner of attachment is possible, for example, by bolts, welding or adhesive as are commonly known in the art. Extending from each mounting flange 22 is a pair of gussets 24 which provide a mount for a hinged attachment. Through the gussets 24 are apertures 26 through which an axle 28 passes for rotational motion.

Figure 2:
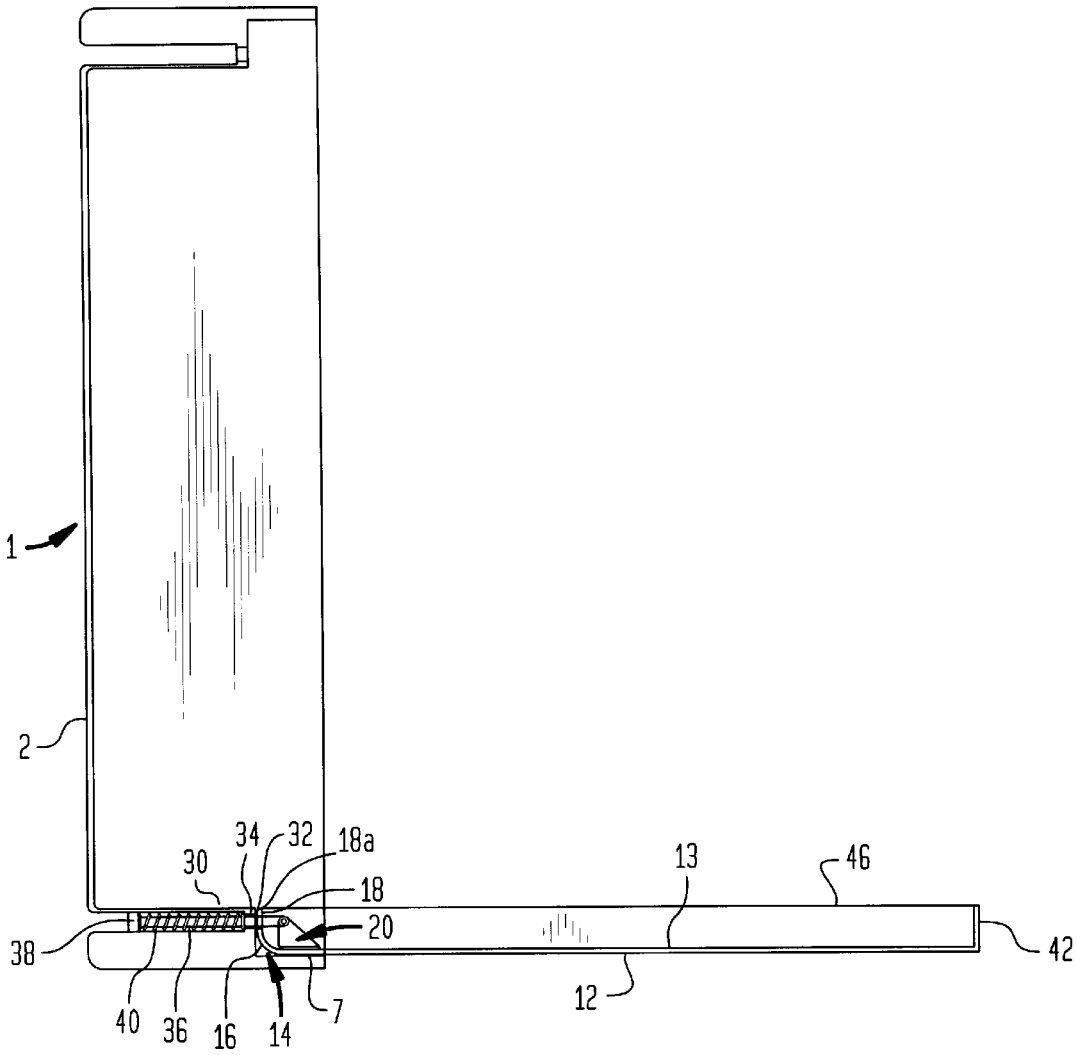
FIG. 2 is a cross sectional view taken along line 2—2 of FIG. 1 showing a pivotable table in its extended position mounted within a BEP, the BEP being only partially illustrated.
Figure 3:
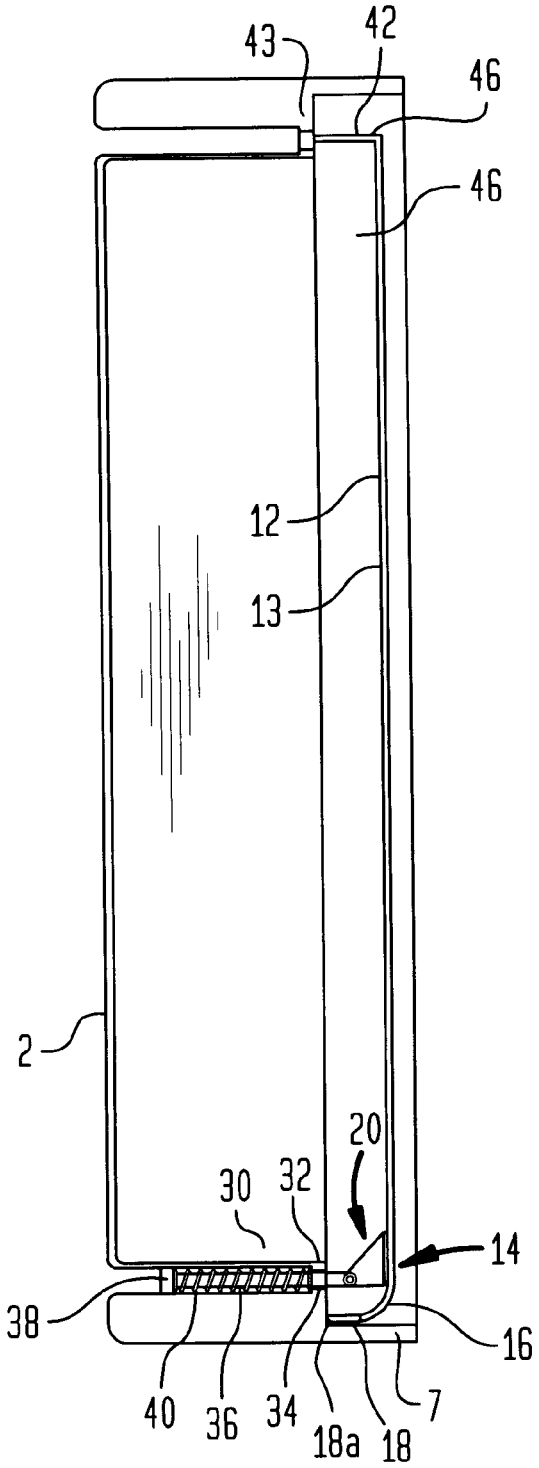
FIG. 3 shows the pivotable table of FIG. 2 in its retracted position.
Figure 5:
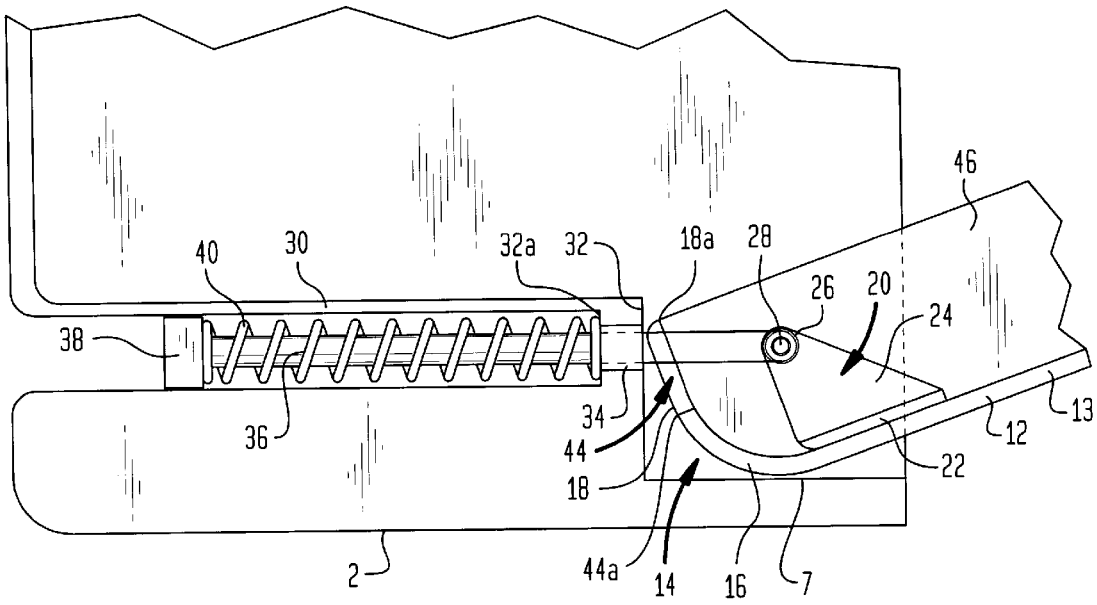
FIG. 5 is a detailed cross sectional view of a portion of the pivotable table mounted within a BEP on an enlarged scale showing the table positioned between its retracted and deployed positions.

The flange 14 of table member 12 is disposed adjacent to a mounting assembly which preferably comprises a plurality of bosses 30 which are attached to housing 2, preferably near the bottom of the housing on or adjacent to the mounting surface 7 as seen in FIGS. 2 and 3. Although a plurality of bosses are preferred and shown, a single boss could be used. As best seen in FIGS. 4 and 5, each boss 30 is arranged opposite from one of the hinge brackets 20 and includes a surface 32 which faces the oppositely sited hinge bracket 20. An aperture 34 passes through each surface 32. The mounting assembly further comprises one or more elongated retention pins 36, a pin extending from each boss 30, each pin passing through a respective aperture 34. Pins 36 are slidably housed within each respective boss. One end of each pin 36 is pivotally attached to the hinge bracket 20 opposite the boss in which the pin is housed, pins 36 being rotatably attached via respective axles 28. The other end of each pin 36 has an enlarged head 38 best seen in FIG. 5. One or more biasing members are operatively associated with the mounting assembly, the biasing members preferably comprising coil springs 40. Each spring 40 is disposed coaxially about each pin 36 and trapped between enlarged head 38 and inner surface 32*a* of boss 30 opposite surface 32. Each spring 40 is compressed between a head 38 and an inner surface 32*a* of a boss 30 to provide biasing forces urging table member 12 toward the bosses 30.

When the table is in the retracted position as seen in FIG. 3 and in detail in FIG. 4, biasing forces from springs 40 acting through pins 36 urge an edge 18*a* of straight segment 18 against surfaces 32 of bosses 30. The biasing forces and the impingement of edge 18*a* against boss surfaces 32 creates torque or twisting force which tends to keep table member 12 in its retracted position. Sidewall 46 located at the end 42 of table member 12 impinges on a similar boss structure 43 to prevent table member 12 from further rotating.

Figure 6:
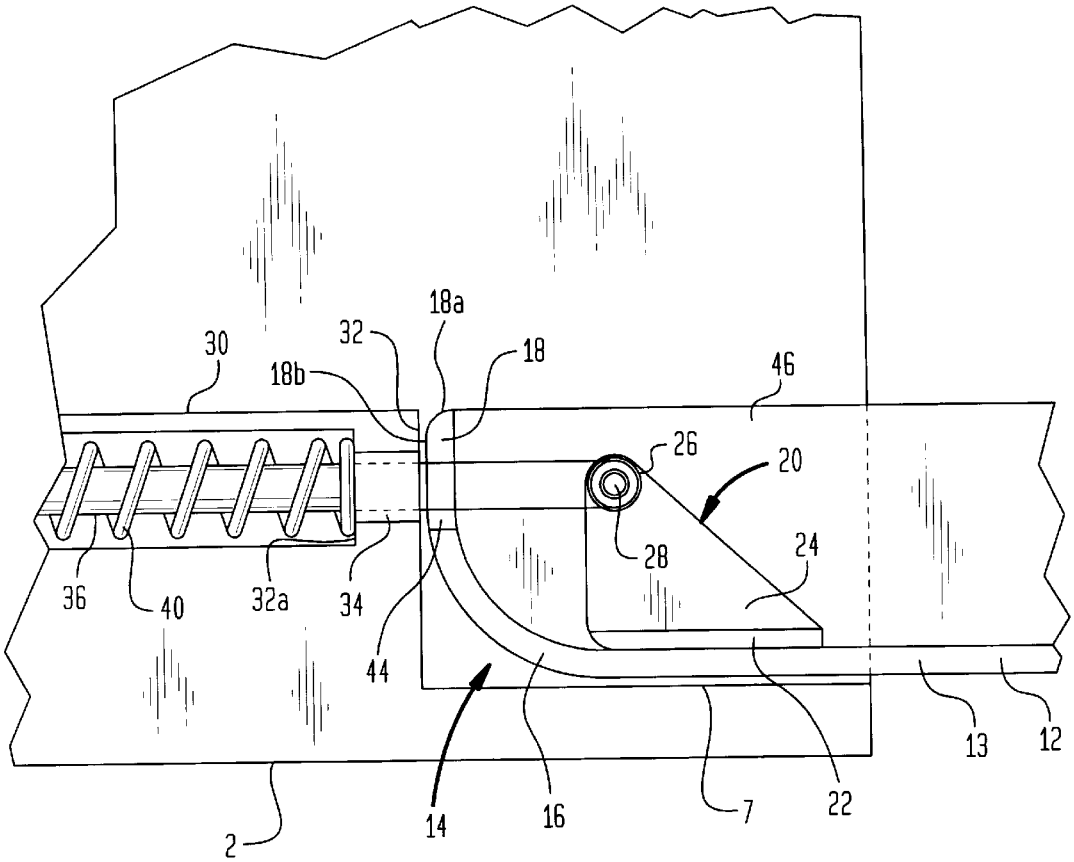
FIG. 6 is a detailed cross sectional view of a portion of FIG. 3 on an enlarged scale.

However, table member 12 can be pivoted into the extended position as seen in the sequence of FIGS. 4, 5 and 6. To extend table member 12 a traction force is applied at the end 42 of table member 12 opposite the hinge brackets 20, thereby pulling the end 42 of table member 12 outwardly from housing 2. Table member 12 pivots about axles 28 drawing pins 36 outwardly from bosses 30 and compressing springs 40 between heads 38 and boss portions 32*a*. Edge 18*a* rides upwardly along surfaces 32 as seen in FIG. 5. Preferably, edge 18*a* is rounded so as not to gouge surfaces 32 and allow table member 12 to pivot smoothly. Curved segment 16 also facilitates the smooth pivoting of table member 12 as readily seen in FIG. 5 where the curved shape of segment 16 passes easily and naturally over mounting surface 7 of housing 2.

Once table member 12 has pivoted into the extended position as seen in FIG. 2 and in detail in FIG. 6, biasing forces from springs 40 draw table member 12 toward bosses 30 so that the outer surface region 18*b* of straight segment 18 is brought into contact with surfaces 32 of bosses 30. Straight segment 18 has cutouts 44 which allow pins 36 to pass through straight segment 18 which is preferably substantially continuous except for the cutouts. Table member 12 is maintained in its extended position at substantially a right angle to housing 2 by the biasing forces drawing outer surface region 18*b* against surfaces 32 as well as pins 36 impinging on straight segment 18 at the bottom 44*a* of cutouts 44.

With table member 12 in the extended position as seen in FIG. 2 the technician servicing BEP 1 has a convenient table on which to place tools and components and to perform tasks such as polishing and splicing optical fibers, using a wire wrap gun and the like.

It is preferred to construct the table member from sheet metal, although other materials, e.g., plastic materials such as PVC, would also serve equally well.

When the technician has completed his tasks table member 12 can be easily pivoted into its retracted position within BEP 1, out of the way but conveniently ready for use the next time the BEP needs servicing. Incorporation of a pivotable work table according to the invention in BEPs and other types of junction boxes or devices provides clear advantages to technicians servicing the device and eliminates the need for the technician to bring a separate table, in addition to the tools and components which he will need to perform his tasks.

What is claimed is:

1. A pivotable work table mountable on a housing, said work table comprising:

a table member comprising a substantially flat plate and a surface portion disposed along one edge of said plate, said surface portion extending substantially perpendicular to said flat plate;

a hinge member attached to said plate adjacent to said surface portion;

a mounting assembly pivotally attached to said hinge member for attaching said table member to one end of the housing; and a biasing member operatively associated with said mounting assembly for biasing said table member toward said housing, said table member being pivotally movable on said hinge member about said mounting assembly between a retracted position within the housing and an extended position in which said table member is oriented perpendicularly to said housing.

2. A pivotable work table according to claim 1, wherein said mounting assembly comprises:

a boss for mounting on said housing, said boss arranged adjacent to said surface portion and opposite said hinge member, said boss having a first surface facing said hinge member; and an interconnecting member communicating between said boss and said hinge member, said interconnecting member being rotatably attached to said hinge member and movably engaging said boss, said biasing member being disposed between said interconnecting member and said boss.

3. A pivotable work table according to claim 2, wherein said surface portion comprises a curved segment extending from said plate through an arc of approximately 90°, and a straight segment extending from said curved segment and oriented substantially perpendicular to said plate.

4. A pivotable work table according to claim 2, wherein said interconnecting member comprises an elongated retention pin and said first surface has an aperture therethrough sized to accept said retention pin for sliding motion within said boss, a first end of said retention pin being rotatably attached to said hinge member, a second end of said retention pin sliding into said boss through said aperture, said retention pin being biased towards said boss by said biasing member.

5. A pivotable work table according to claim 4, wherein said surface portion has a cutout positioned and sized to accept said retention pin.

6. A pivotable work table according to claim 4, wherein said retention pin has an enlarged head at said second end thereof and said biasing member comprises a coil spring coaxially disposed around said pin between said head and said boss opposite said first surface, compression of said spring biasing said table member against said boss.

7. A pivotable work table according to claim 1, further comprising a plurality of sidewalls extending perpendicularly from said plate and arranged around the perimeter thereof thereby forming a trough.

8. A pivotable work table according to claim 7, wherein said table member is made of sheet metal.

9. A pivotable work table according to claim 1, wherein said housing comprises a building entry protection unit.

10. A pivotable work table according to claim 9, wherein said table member is arranged inside said building entry protection unit when in a retracted position, said table member extending out from and being substantially perpendicular to said building entry protection unit when in an extended position.

11. A pivotable work table, comprising:

a table member comprising a substantially flat plate and a flange disposed along one edge of said plate, said flange comprising a curved portion extending from said plate through an arc of approximately 90° and a straight portion extending from said curved portion substantially perpendicular to said plate;

a plurality of hinge brackets mounted on said plate in a spaced apart relation adjacent to said flange;

a plurality of bosses, each boss being disposed opposite a respective hinge bracket, each boss comprising a first surface oriented substantially vertically and facing said respective hinge bracket, each boss having an aperture through said surface;

a plurality of elongated retention pins, each pin being housed in a respective boss for sliding motion through said aperture therein, a first end of each pin extending from said respective boss and being pivotally attached to said hinge bracket opposite said boss; and a plurality of biasing members, each biasing member communicating between a respective retention pin and a respective boss in which said retention pin is housed, each biasing member for urging said table member toward said plurality of bosses, said table member being rotatable on said retention pins relative to said bosses for pivoting motion between a retracted position wherein said table member is oriented substantially vertically, and an extended position wherein said table member is oriented substantially horizontally.

12. A pivotable work table according to claim 11, wherein said table member is made of sheet metal.

13. A pivotable work table according to claim 11, wherein said table member further comprises a plurality of sidewalls extending substantially perpendicular from said plate forming a trough.

14. A pivotable work table according to claim 11, wherein each of said retention pins has an enlarged head disposed at a second end thereof, and each of said biasing members comprises a coil spring coaxially disposed around a respective pin between said head and said boss opposite said surface, said spring compressing between said head and said boss and urging said table member toward said bosses.

15. A pivotable work table according to claim 11, further comprising a plurality of cutouts disposed in said flange, each cutout being located adjacent to a respective boss for allowing said retention pins to extend from said respective boss to a respective hinge bracket.

16. A pivotable work table according to claim 11, wherein said bosses are attached to a building entry protection unit.

17. A pivotable work table according to claim 16, wherein said table member is arranged inside said building entry protection unit when in said retracted position, said table member extending out from and being substantially perpendicular to said building entry protection unit when in said extended position.

18. A housing having a pivotable work table, comprising:

a housing member having a mounting surface extending therefrom;

a table member comprising a substantially flat plate and a surface portion disposed along one edge thereof, said surface portion extending substantially perpendicular to said plate and being arranged adjacent to said mounting surface;

a hinge member attached to said plate adjacent to said surface portion;

a boss attached to said housing on said mounting surface, said boss being located adjacent to said surface portion and opposite of said hinge member, said boss having a first surface facing said hinge member;

an interconnecting member communicating between said boss and said hinge member, said interconnecting member being rotatably attached to said hinge member and movably engaging said boss; and a biasing member disposed between said interconnecting member and said boss for biasing said table member toward said boss, said table member being movable relative to said boss between a retracted position wherein said plate is oriented substantially parallel to said first surface and contained substantially within said housing member, and an extended position wherein said plate is oriented substantially perpendicular to said first surface and extending from said housing member, said biasing member for urging said surface portion into interengagement with said first surface for maintaining said table member in either said extended or retracted positions.

19. A housing according to claim 18, wherein said surface portion comprises a curved segment extending from said plate through an arc of approximately 90°, and a straight segment extending from said curved segment and oriented substantially perpendicular to said plate.

20. A housing according to claim 18, wherein said interconnecting member comprises an elongated retention pin and said first surface has an aperture therethrough sized to accept said retention pin for sliding motion within said boss, a first end of said retention pin being rotatably attached to said hinge member, a second end of said retention pin sliding into said boss through said aperture, said retention pin being biased toward said boss by said biasing member.

21. A housing according to claim 20, wherein said surface portion has a cutout positioned and sized to accept said retention pin when said table is in said extended position.

22. A housing according to claim 20, wherein said retention pin has an enlarged head at said second end thereof and said biasing member comprises a coil spring coaxially disposed around said pin between said head and said boss opposite said first surface, compression of said spring biasing said table member against said boss in either said retracted or extended position.

23. A housing according to claim 18, further comprising a plurality of sidewalls extending perpendicularly of said plate and arranged around the perimeter thereof thereby forming a trough.

24. A housing according to claim 23, wherein said table member is made of sheet metal.

25. A housing according to claim 18, wherein said housing member is a building entry protection unit.

* * * * *